US005898789A

United States Patent [19]

Nichols et al.

[11] Patent Number: 5,898,789

[45] **Date of Patent: *Apr. 27, 1999**

[54] ELECTRICAL DEVICE AND SIGNAL CABLE ASSEMBLY

[75] Inventors: Jerry R. Nichols, Boynton Beach; Jorge L. Garcia, Plantation, both of Fla.; John C. Dzung, Ft. Worth, Tex.

[73] Assignee: Motorola, Inc., Schaumburg, Ill.

[ * ] Notice: This patent is subject to a terminal disclaimer.

[21] Appl. No.: 08/656,650

[22] Filed: May 31, 1996

[51] Int. Cl.[6] ..... H04R 25/00

[52] U.S. Cl. ..... 381/361; 381/355

[58] Field of Search ..... 381/168, 169, 381/155, 91, 92, 361, 362, 366, 355; 379/433

[56] References Cited

U.S. PATENT DOCUMENTS 4,679,233 7/1987 Richardson et al. ..... 379/433
5,378,882 1/1995 Gong et al. ..... 235/472
5,701,355 12/1997 Brannan et al. ..... 381/355

FOREIGN PATENT DOCUMENTS 2223145 3/1990 United Kingdom ..... 381/169

*Primary Examiner*—Huyen Le
*Attorney, Agent, or Firm*—Andrew S. Fuller

[57] ABSTRACT

An electrical device assembly (120) has a removable signal cable assembly (180). The electrial device assembly (120) includes a circuit substrate (110) which is encapsulated by a device housing (121). The device housing (121) includes two mechanically coupled housing members (130, 140). The housing members (130, 140) are secured together by a retainer (190) mounted to a signal cable (181), that is removably connected to the electrical device assembly (120). Preferably, the housing members (130, 140) have overlapping loop portions (135, 145), and the retainer (190) mounted through the loop portions (135, 145) to secure the housing members (130, 140) together, and to secure the signal cable assembly (180) to the electrical device assembly (120).

25 Claims, 2 Drawing Sheets

ELECTRICAL DEVICE AND SIGNAL CABLE ASSEMBLY

TECHNICAL FIELD

This invention relates in general to communication systems, and more particularly, to the conditioning of a digitally modulated signal, such as for amplification purposes.

BACKGROUND

Signal cables are often attached to electronic devices to support the transfer of signals and/or power to and from the electronic device. In a typical example, a hand-held microphone has a signal cable located at its base which connects to a mobile communication unit. Ordinarily, the microphone is welded or assembled using screws or other fasteners, and the cable permanently secured to the microphone using a strain relief member. Wires from the cable attach to circuitry internal to the microphone. Such arrangement is typical for electrical devices having an attached power or signal cable.

In many instances, a cable attached to a device becomes damaged or destroyed thereby rendering the tethered device unusable. Some implementations provide for cable connections which support user replacement of damaged or worn cables. A cable may have a multi-pin electrical connector which plugs into a mating connector located on the device. For applications requiring ruggedized cable connections that can withstand substantial stress, a cable collar has been used to provide primary strain relief support. One such example is described in U.S. Pat. No. 5,378,882 issued on Jan. 3, 1995, to Gong et al., for a Bar Code Symbol Reader With Locking Cable Connector Assembly. Here, a signal cable is removably connected to a handle of a hand held bar code reader, and the cable interface provided with a gasket to protect against environmental contaminants, such as dust and the like.

It is desirable to have electronic device and signal cable assemblies which are easily manufactured, and which have reduced weight, part count, and manufacturing costs, with consideration given to reducing assembly time, and number of assembly operations. Preferably, the electronic device has a user replaceable cable connection that is sealed to survive water submersion.

DETAILED DESCRIPTION OF THE PREFERRED EMBODIMENT

Generally, the present invention provides for an electrical device and signal cable assembly. The electrical device includes a circuit substrate having electrical circuitry, such as for controlling a microphone. An electrical connector is coupled to the electrical circuitry. A device structure encompasses the circuit substrate and connector, and includes two housing members that together have overlapping loop portions. A signal cable having a retaining member is disengagably mounted through at least a portion of the overlapping loop portions to secure the housing members together, and to secure the signal cable to the device housing. Preferably, the housing members are mechanically coupled at one end, and secured together by the retaining member of the signal cable at an opposite end. In the preferred embodiment, the interface between the signal cable and the device housing is sealed, and the interface between the signal cable and retaining member sealed, to provide a submersible electrical device.

Figure 1:
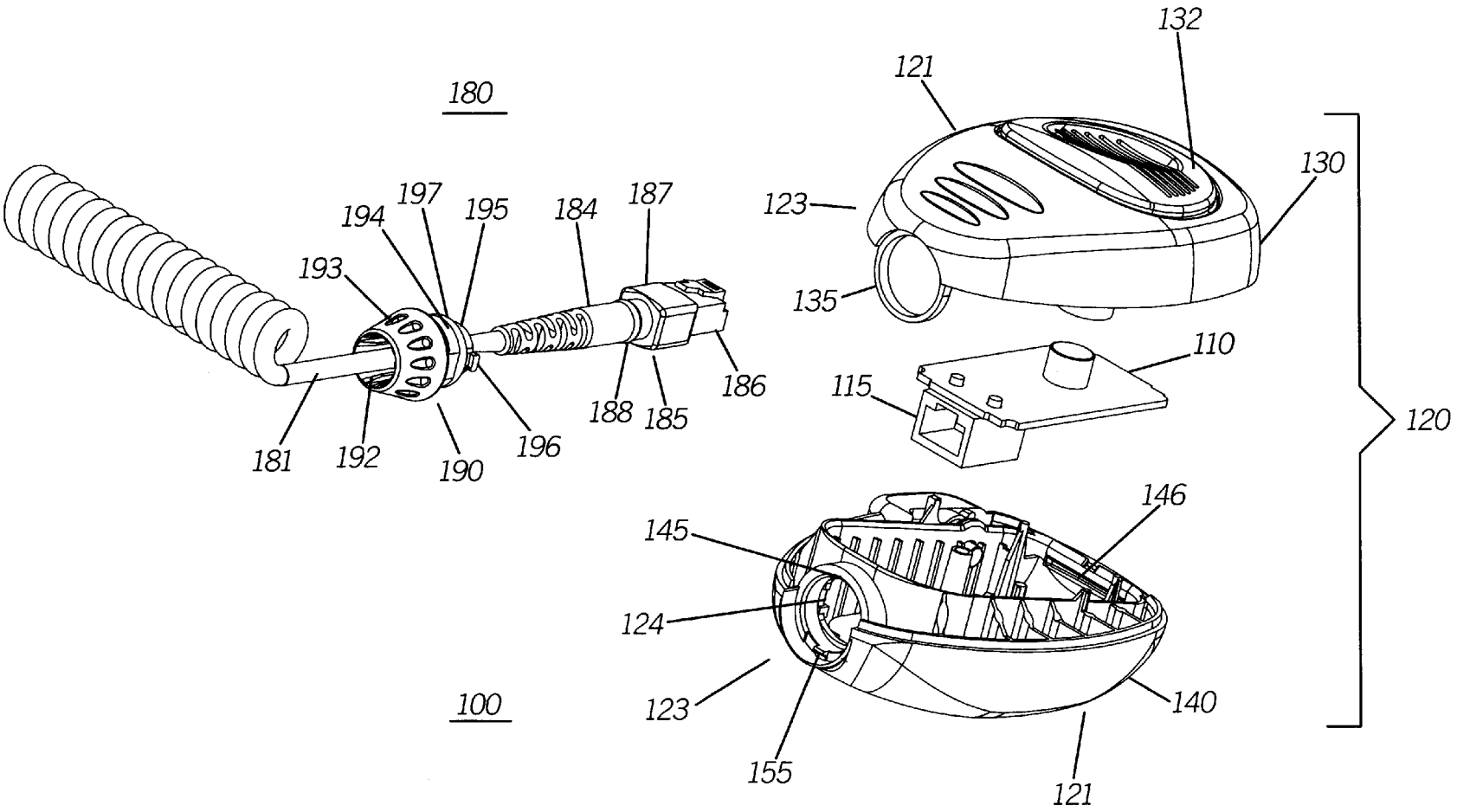
FIG. 1 is a exploded perspective view of a microphone and signal cable assembly, in accordance with present invention.
Figure 2:
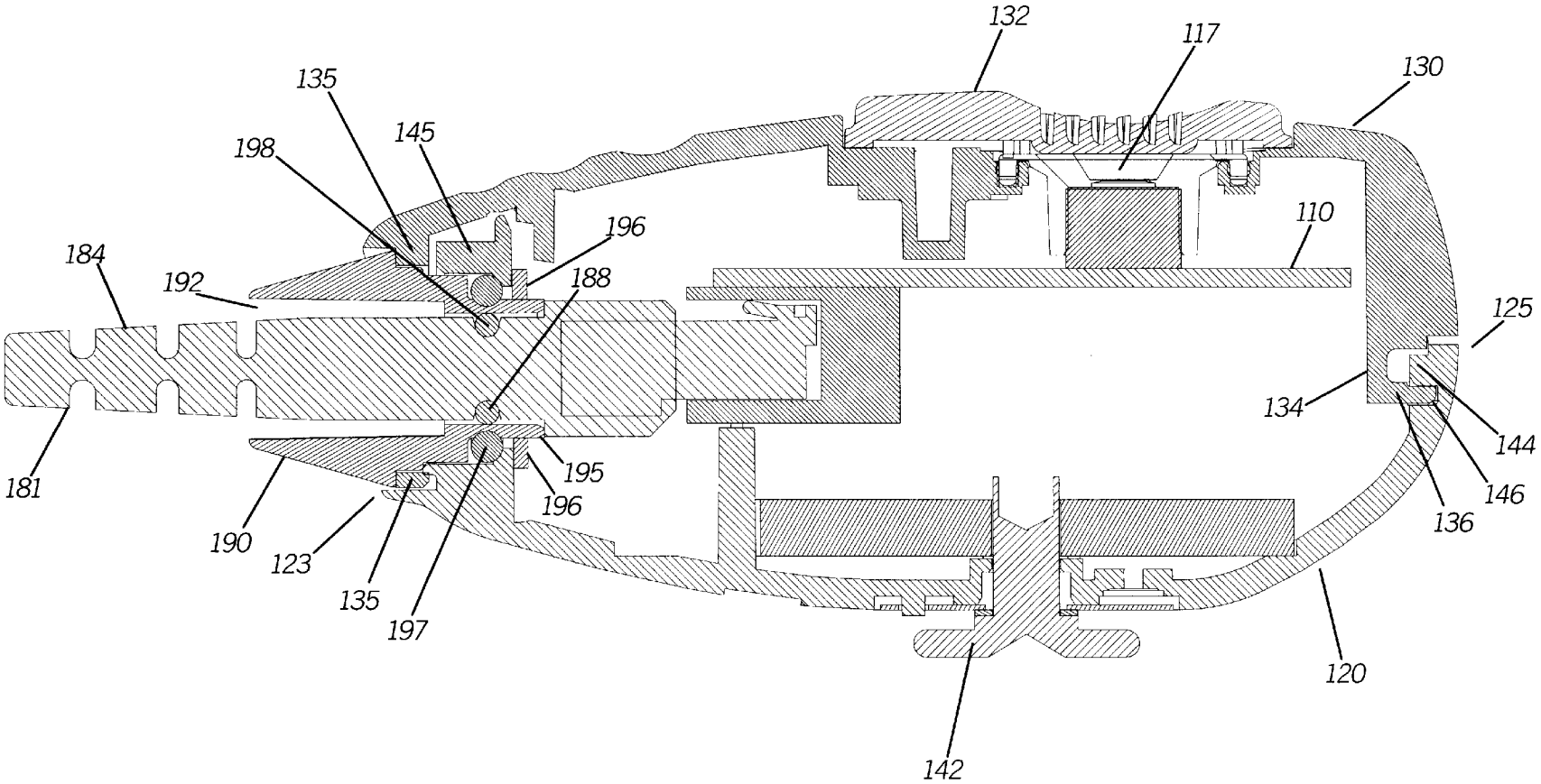
FIG. 2 is a cross-sectional view of the microphone and signal cable assembly of FIG. 1.

FIG. 1 is an exploded perspective view of a microphone and signal cable assembly 100, in accordance with the present invention. FIG. 2 is a cross-sectional view of the microphone and signal cable assembly 100 when fully assembled, in accordance with the present invention. Referring to FIGS. 1 and 2, the microphone and signal cable assembly 100 includes a microphone assembly 120 and a signal cable assembly 180.

The signal cable assembly 180 includes an electrical signal cable 181 that supports the transmission of electrical signals to and from the microphone assembly 120. The cable 181 has a terminal end portion 185 that has a male multi-pin connector 186 formed thereon. The connector 186 of the preferred embodiment is similar to a conventional modular telephone plug with the locking tab preferably removed to facilitate disconnection. The connector 186 is formed to mate with a corresponding female connector 115 of the microphone assembly 120. The connector 186 is secured to the cable by a molded connector base 187. A strain relief member 184 is formed about the cable 181 at the connector base 187.

A locking retaining member or cable retainer 190 is slidably mounted along the cable and has a central bore or cavity 192 sufficiently large to receive, without substantial interference, the cable 181 and strain relief member 184. Preferably, the central bore 192 is smaller than the connector base 187 to prevent separation of the retaining member 190 from the cable 181. An O-ring seal 188, mounted within a slot in the strain relief member 184, provides a radial seal between the retaining member 190 and the cable 181. The locking retaining member 190 buttresses against the connector base 187 when the retaining member 190 is slid towards the terminal end 185 of the cable 181. The retaining member 190 includes a lower collar portion 194 having a key portion 195 extending there from. The key portion 194 has opposing locking stubs 196 projecting radially outward from an outer surface of the key portion 195. An O-ring seal 197 is mounted between the projecting stubs 196 of the key portion 195 and the collar portion 194. The retaining member 190 is rotatable about the cable 181 and has a friction enhancing portion 193 to support such rotation. The cable assembly 180 is disengagably mounted to the microphone assembly 120.

The microphone assembly 120 comprises a device housing structure 121 that forms a protective enclosure for internal electrical and mechanical components 110, 115, 117. The internal components 110, 115, 117 include a circuit substrate 110, having microphone control circuitry thereon, and an electrically coupled microphone 117. The microphone 117 is mechanically coupled to the circuit substrate 110, and electrically coupled to the microphone control circuitry. The microphone receives audio input from a user which is processed to provide an audio signal. The microphone control circuitry provides for operational control of the microphone 117.

A female multi-pin electrical connector 115, corresponding to the male connector 186 of the cable assembly 180, is mounted or otherwise mechanically coupled to the circuit substrate 110. The electrical connector 115 is electrically coupled to the microphone control circuitry of the circuit substrate 110, and supports the transfer of input and output electrical signals to and from the microphone assembly 120. In the preferred embodiment, the female electrical connector 115 is formed using a standard modular type telephone jack connector, which has a receiving cavity for accepting the male multi-pin plug-in connector 186.

The device housing 121 includes two housing members 130, 140. The housing members 130, 140 together encompass or encapsulate the circuit substrate 110, electrical connector 115, and microphone 117, and other internal components of the microphone assembly. In the preferred embodiment, one housing member 130 forms a front cover and user interface portion for the microphone assembly, and another housing member 140 forms a back cover for the microphone assembly. A microphone grill 132 on the front cover 130 provides user access to the microphone 117. An attachment clip 142 on the back cover 140 facilitates mounting of the microphone assembly 120. Preferably, the device housing 121 is formed from molded plastic, and has molded features for securing both housing members together.

The housing members 130, 140 have complementary retaining features for securing both housing members together. In the preferred embodiment, these retaining features include a tongue and groove arrangement formed at one end 125 of the device housing 121, and an overlapping ring or loop structure 135, 145 formed at an opposing end 123 of the device housing 121. The tongue and groove arrangement is formed from interlocking hook or catch portions 134, 144 on the two housing members 130, 140. In the preferred embodiment, the back cover housing member 140 has a slot or groove 146, which receives a protruding portion or tongue 136 on the front cover housing member 130. The interlocking hook portions 134, 144 allow a pivoting action at the intersection of the two housing members 130, 140 for assembly purposes. The overlapping ring structure forms a basis for securing both housing members together. In the preferred embodiment, the bottom cover housing member 140 has a ring or loop portion 145 slightly recessed at the base of the device housing 123. The top cover housing member 130 has a corresponding loop or ring portion 135 that is located adjacent to the loop portion 145 when both housing members 130, 140 are assembled together.

According to the present invention, the overlapping loop portions 135, 145, together with the retaining member 190 of the signal cable assembly 180, provide a locking arrangement that secures both housing members 130, 140 together without the need for additional fasteners such as screws, snaps, welds, or the like. When the housing members are properly oriented, the ring portions are concentrically aligned to have a hole extending therethrough. In the preferred embodiment, a snap portion or tab 155 on the ring 145 on the back cover housing member 140 engages the ring 135 on the front cover housing member 130 to retain the rings 135, 145 in an overlapping concentric arrangement. The retaining member 190 fits within the hole formed by the concentric ring portions in a pin-through-ring locking arrangement that provides a primary support for securing both housing members together. The snap portion 155 provides a secondary support for maintaining the rings in a concentric arrangement when the cable retainer 190 is not inserted.

To assemble the microphone of the preferred embodiment, the two housing members are brought together such the tongue portion 136 of the top cover 130 engages the groove portion 146 of the bottom cover 140. The housing members 130, 140 are then brought together, by pivoting, such that the ring portion 135, 145 on each housing member is concentrically aligned. The tab 155, if present, maintains the alignment of the concentric rings, and is easily disengagable so as to separate both housing members. The signal cable assembly 180 is then attached by aligning the male connector 186 to be received by the female connector 115 of the microphone assembly 120. The connector 186 is then inserted through both concentric rings into the microphone assembly until properly seated within the female connector 115. The retaining member 190 is then slid along the cable 181 and aligned such that the projections 196 on the key portion 195 are aligned with corresponding key slots 124 within the cavity formed by the concentric rings 135, 145. The retaining member 190 is inserted until the key projections 196 clear the key slots 124. The retaining member 190 is then rotated into a locked position.

Thus, removal of the cable from the microphone assembly is restricted when the key portion engages the device housing. With the retaining member 190 in a locked position, the O-ring seal 197 extending around the collar 194 of the retaining member 190 is radially compressed to provide an environmental seal between the retaining member 190 and the device housing 121. Similarly, the O-ring 188 is radially compressed to seal between the retaining member 190 and the cable 181. The concentric rings 135, 145 are held in place to prevent the housing members 130, 140 from separating. Thus, the housing members are assembled together, and the signal cable assembled to the housing members.

The present invention offers significant advantages over the prior art. For example, the retaining member that secures the signal cable to the device housing also serves as a primary support for securing together the housing members encompassing the internal components of the electrical device. This dual function of the signal cable retaining member serves to eliminate the need for screws, snaps, welds, and other fasteners to secure the housing members together, thereby facilitating the assembly process. The loops are preferably maintained in alignment when the signal cable is removed to facilitate user replacement of the cable without the device housing coming apart. This assembly arrangement presents significant advantages, such as quick assembly and disassembly for manufacturing and repair purposes.

While the preferred embodiment of the invention has been illustrated and described, it will be clear that the invention is not so limited. For example, the loops described need not be closed or circular. The retaining member may be threaded or have multiple components. Additionally, electrical devices other than microphone assemblies are contemplated. Numerous other modifications, changes, variations, substitutions and equivalents will occur to those skilled in the art without departing from the spirit and scope of the present invention as defined by the appended claims.

What is claimed is:

1. An electrical device and signal cable assembly, comprising:

a circuit substrate having electrical circuitry;

an electrical connector coupled to the electrical circuitry;

a device housing structure encompassing the circuit substrate, and comprising first and second housing members that mate together to form front and back cover assemblies, respectively, and that together define a cavity for housing the circuit substrate, wherein:

the first housing member has a first loop portion;

the second housing member is captured by the first housing member, and having a second loop portion overlapping the first loop portion;

a signal cable having a connector portion mated to the electrical connector in a plug and socket arrangement; and a cable retainer mounted around the signal cable and through at least a portion of the first and second loops and providing a primary support structure that secures the first and second housing members together, and that secures the signal cable to the device housing structure.

2. The electrical device and signal cable assembly of claim 1, wherein the first loop portion has a snap portion the engages the second loop portion to retain the first and second loop portions in an overlapping concentric arrangement.

3. An electrical device and signal cable assembly, comprising:

a circuit substrate having electrical circuitry;

an electrical connector coupled to the electrical circuitry;

a device housing structure encompassing the circuit substrate, and comprising:

a first housing member having a first loop portion;

a second housing member captured by the first housing member, and having a second loop portion overlapping the first loop portion;

a signal cable having a connector portion mated to the electrical connector;

a cable retainer mounted around the signal cable and through at least a portion of the first and second loops to secure the first and second housing members together, and to secure the signal cable to the device housing structure;

wherein the first loop portion has a snap portion that engages the second loop portion to retain the first and second loop portions in an overlapping arrangement; and wherein the first and second housing member at least partially separate when the cable retainer is disengaged from the device housing structure and the snap portion disengaged from the second loop portion.

4. The electrical device and signal cable assembly of claim 1, wherein the first loop portion has a key slot, and the cable retainer has a matching key portion.

5. The electrical device and signal cable assembly of claim 1, further comprising an O-ring seal mounted between the cable retainer and the device housing structure.

6. The electrical device and signal cable assembly of claim 1, further comprising an O-ring seal mounted between the cable retainer and the signal cable.

7. The electrical device and signal cable assembly of claim 1, wherein the electrical connector is mounted on the circuit substrate.

8. The electrical device and signal cable assembly of claim 1, wherein the electrical circuitry comprises microphone control circuitry.

9. A microphone assembly, comprising:

a circuit substrate having microphone control circuitry;

an electrical connector coupled to the microphone control circuitry;

a housing structure having first and second housing members attached together to encompass the circuit substrate and electrical connector, wherein:

the first housing member has a first end portion with a first retainer, and a second end portion opposite to the first end portion, the second end portion having a first ring;

the second housing member has a first end portion with a second retainer mated with the first retainer, and a second portion having a second ring, the first and second rings being aligned to have a hole extending therethrough;

an electrical cable mounted through the hole, and having a connector portion mated to the electrical connector; and a locking retainer mounted around the electrical cable and within the hole through the first and second rings, and engaging the housing structure to secure the first and second housing members together, and the electrical cable to the housing structure.

10. The microphone assembly of claim 9, further comprising an O-ring seal mounted between the locking retainer and the housing structure.

11. The microphone assembly of claim 10, further comprising an O-ring seal mounted between the locking retainer and the electrical cable.

12. The microphone assembly of claim 9, wherein the first ring has a snap portion that engages the second ring to retain the first and second rings in an overlapping concentric arrangement.

13. The microphone assembly of claim 12, wherein the first and second housing member at least partially separate when the locking retainer is disengaged from the housing structure and the snap portion disengaged from the second ring.

14. The microphone assembly of claim 9, wherein the first ring has a key slot, and the locking retainer has a key portion form fitted for the key slot.

15. An electrical device assembly, comprising:

a device housing comprising first and second open-faced housing members mated together to define a cavity to house a circuit carrying substrate, the first and second housing members having complementary interlocking portions for securing the first and second housing members together, the first and second housing members having overlapping loop portions; and a signal cable having a retainer disengably mounted through at least a portion of the overlapping loop portions to secure the first and second housing members to each other, and to secure the signal cable to the device housing.

16. The electrical device assembly of claim 15, wherein the retainer is slidably mounted around the signal cable.

17. The electrical device assembly of claim 16, further comprising an O-ring seal disposed between the signal cable and the retainer.

18. The electrical device assembly of claim 16, further comprising an O-ring seal mounted between the retainer and the device housing.

19. The electrical device assembly of claim 15, further comprising a snap attached to the device housing to retain the overlapping loop portions in a concentric arrangement when the retainer is disengaged from the overlapping loop portions.

20. The electrical device assembly of claim 15, wherein the first and second housing members have corresponding catch portions opposite the overlapping loop portions located are attached to the device housing to retain the overlapping loop portions in a concentric arrangement when the retainer is disengaged from the overlapping loop portions.

21. An electrical device assembly, comprising:

a circuit carrying substrate;

a device housing encapsulating the circuit carrying substrate, the device housing comprising first and second housing open-faced members that are mechanically coupled together and that when mated together define an enclosure that houses the circuit carrying substrate; and a signal cable having a retaining member disengably mounted to the device housing, the retaining member providing a primary support that secures the first and second housing members together to form an assembly.

22. The electrical device assembly of claim 21, further comprising a microphone encapsulated by the first and second housing members.

23. The electrical device assembly of claim 22, wherein the first and second housing members have adjacent ring portions, and the retaining member is mounted within the ring portions to restrict disassembly of the first and second housing members.

24. The electrical device assembly of claim 23, wherein the retaining member is slidably mounted around the signal cable.

25. The electrical device assembly of claim 24, further comprising:

a first O-ring seal disposed between the signal cable and the retaining member; and a second O-ring seal mounted between the retaining member and the device housing.

* * * * *